US005133324A

United States Patent [19]

Michiaki

[11] Patent Number: 5,133,324

[45] Date of Patent: Jul. 28, 1992

[54] EJECTOR PUMP FOR VEHICLE FUEL TANK

[75] Inventor: Sasaki Michiaki, Kanagawa, Japan

[73] Assignee: Nissan Motor Co., Ltd., Kanagawa, Japan

[21] Appl. No.: 627,099

[22] Filed: Dec. 13, 1990

[30] Foreign Application Priority Data

Dec. 13, 1989 [JP] Japan ..... 1-323247

[51] Int. Cl.[5] ..... F04F 5/00

[52] U.S. Cl. ..... 123/514; 137/846; 417/79; 123/510

[58] Field of Search ..... 123/509, 514, 510; 137/147, 571, 574, 565, 846; 417/77, 79, 80

[56] References Cited

U.S. PATENT DOCUMENTS

| | | | |
|---|---|---|---|
| 2,453,156 | 9/1960 | Bryant | 137/571 |
| 2,812,715 | 11/1957 | Redding | 417/79 |
| 3,118,468 | 1/1964 | Bochan | 137/846 |
| 3,133,696 | 5/1964 | Mirando | 137/846 |
| 3,275,061 | 9/1966 | Williams | 417/79 |
| 3,422,844 | 1/1969 | Grise | 137/846 |
| 3,730,217 | 5/1973 | Gote | 137/846 |
| 4,340,023 | 7/1982 | Creager | 123/514 |
| 4,501,374 | 2/1985 | Robertson | 137/846 |
| 4,702,215 | 10/1987 | Lebold | 123/514 |
| 4,834,132 | 5/1989 | Sasaki | 123/514 |

FOREIGN PATENT DOCUMENTS

| | | |
|---|---|---|
| 59-190628 | 12/1984 | Japan . |
| 61-65067 | 4/1986 | Japan . |

*Primary Examiner*—Carl Stuart Miller
*Attorney, Agent, or Firm*—Pennie & Edmonds

[57] ABSTRACT

In an ejector pump provided within a saddle-shaped fuel tank for an automotive vehicle to feed fuel from a subchamber to a main chamber through a suction pipe due to a vacuum generated by fuel returned from an engine to the fuel tank via a return pipe, the ejector pump comprises a return pipe connecting portion connected to the return pipe; a suction pipe connecting portion connected to the suction pipe; a nozzle formed at an end of the return pipe connecting portion; a pump housing coupled to the two pipe connecting portions, for forming a vacuum chamber and a throat portion; and in particular elastic reverse-conical shaped check valve provided within the return pipe connecting portion to prevent fuel from flowing reversely from the fuel tank in case of trouble. Further, since the check valve can be used in common with a sealing member and further with the nozzle, it is possible to simplify the ejector pump structure and assembly work without reducing the fuel tank capacity.

6 Claims, 5 Drawing Sheets

EJECTOR PUMP FOR VEHICLE FUEL TANK

BACKGROUND OF THE INVENTION

1. Field of the Invention

The present invention relates to an ejector pump for an automotive vehicle fuel tank and more specifically to an ejector pump provided within a saddle-shaped fuel tank to feed fuel from a subchamber to a main chamber. Here, the ejector pump is a kind of pump for jetting a pressurized . water (fuel) through ;a nozzle to eject water (fuel) around the nozzle which uses no moving elements.

2. Description of the Prior Art

There exists a fuel tank provided with a fuel reverse flow prevention device for preventing fuel from flowing in the reverse direction from the fuel tank to the outside through a return tube, as disclosed in Japanese Published Unexamined (Kokai) Utility Model Appli. No. 59-190628. In this prior-art fuel tank, the fuel reverse flow can be prevented by providing an air chamber formed with a port communicating with a space within a tank at an end of the return tube at such a position that the end of the return tube is located in a space within the air chamber when the vehicle is overturned.

On the other hand, there exists a saddle-shaped fuel tank for an automotive vehicle, which is formed with a middle raised bottom portion extending from the bottom wall of into the tank. This saddle shape is required structural restriction of the vehicle body in which which the fuel tank is mounted, as disclosed in Japanese Published Unexamined (Kokai) Patent Appli. No. 61-65067. In the above-mentioned fuel tank, the fuel tank is partitioned by a raised bottom portion into a main chamber and a subchamber at roughly the lower half level within the tank body. When the liquid level drops below the raised bottom portion within the fuel tank, it is necessary to transfer fuel from the subchamber to the main chamber within the fuel tank by an ejector pump attached to an end of a return pipe for returning excessive fuel supplied to the engine into the fuel tank again. The more detailed description of the saddle-shaped fuel tank provided with an ejector pump will be made under DETAILED DESCRIPTION OF PREFERRED EMBODIMENTS with reference to FIG. 1.

In the above-mentioned saddle-shaped fuel tank provided with the ejector pump, however, since an ejector operation is effected owing to the fuel recirculated through the return pipe, there exists a problem in that it is impossible to provide a fuel reverse-flow prevention device (i.e. an air chamber) as disclosed in the former Kokai Appli. No. 59-190628 at an end of the return pipe.

Although it may be possible to provide a fuel reverse flow prevention device of different type for the saddle-shaped fuel tank, in this case there arise various problems for example, in that the number of parts increases, the tank capacity decreases due to the presence of the prevention device and the manufacturing cost becomes high.

SUMMARY OF THE INVENTION

With these problems in mind, therefore, it is the primary object of the present invention to provide an ejector pump provided with a low costly fuel reverse flow prevention device, which is usable for a saddle-shaped fuel tank for an automotive vehicle.

To achieve an above-mentioned object, the ejector pump is provided with a saddle-shaped fuel tank (1) for an automotive vehicle to feed fuel from a subchamber (4) to a main chamber (3) via a suction pipe (11) due to a vacuum generated by fuel returning from an engine to the fuel tank via a return pipe (8). The present ejection pump comprises: (a) a return pipe connecting portion (22) connected to the return pipe (8); (b) a suction pipe connecting portion (23) connected to the suction pipe (11); (c) a nozzle (28) formed at an end of said return pipe connecting portion, for jetting fuel returned from the engine through the return pipe; (d) a pump housing (20) coupled to said return pipe connecting portion and said suction pipe connecting portion, said vacuum housing being formed with a vacuum chamber (30) under ends of said return and suction pipe connecting portions and a throat portion (32) under the end of said return pipe connecting portion; and (e) check valve means (CV) provided within said return pipe connecting portion, for preventing fuel from flowing in the reverse direction from said main chamber to the outside of the fuel tank.

The check valve means (CV) is formed of an elastic material and into a reverse conical shape having a hole at an apex thereof. The reverse conical shaped check valve means is used in common with a sealing member interposed between the return pipe and the return pipe connecting portion. Further, the reverse conical shaped check valve can be used in common with the nozzle formed at the end of the return pipe connecting portion. Further, the nozzle end of the reverse conical shaped check valve is formed into a partially offset state to reduce abnormal noise produced when fuel including bubbles is returned to the fuel tank. Further, a whirler is preferably provided on the upstream side of the nozzle to effectively diffuse fuel through the nozzle.

In the ejector pump according to the present invention, since the check valve means is provided within the return pipe connecting portion, it is possible to prevent fuel from flowing in the reverse direction from the main chamber to the outside of the fuel tank via the return pipe. Further, since the check valve means is disposed 1 within the ejector pump, it is possible to simplify the ejector pump mounting work in the fuel tank without reducing the tank capacity. Further, since the check valve means can be used in common with a sealing member between the return pipe and the return pipe connecting portion and further in common with the nozzle, it is possible to reduce the number of parts and reduce the cost thereof.

DETAILED DESCRIPTION OF THE PREFERRED EMBODIMENTS

Prior to the description of an ejector pump according to the present invention, a saddle-shaped fuel tank for an automotive vehicle to which the ejector pump according to the present invention is applied will be described hereinbelow.

Figure 1:
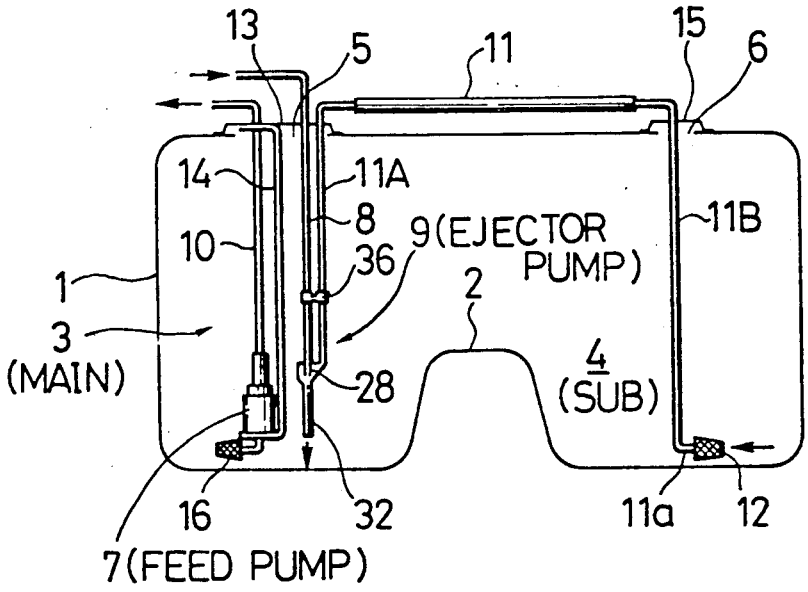
FIG. 1 PRIOR ART
FIG. 1 is an illustration for assistance is explaining a saddle-shaped fuel tank for an automotive vehicle.

FIG. 1 is an illustration showing a prior-art saddle-shaped fuel tank 1 formed with a raised bottom portion 2 at the middle bottom portion thereof. This raised bottom portion 2 divides or partitions the roughly lower portion of the tank 1 into a main chamber 3 (on the left side) and a subchamber 4 (on the right side). Further, the tank 1 is formed with a first working hole 5 in an upper tank body wall over the main chamber 5 and a second working hole 6 in the same upper tank body wall over the subchamber 4. The first working hole 5 is closed by a first lid 13 and the second working hole 6 is closed by a second lid 15, respectively.

A feed pump 7 attached to the lower end of an outlet pipe 10 is inserted into the main chamber 3 through the first working hole 5 and supported by a stay 14 fixed to the first lid 13. The upper end of the outlet pipe 10 is connected to a fuel supply device (not shown) to supply fuel from the fuel tank 1 to the fuel supply device by the feed pump 7 having a filter 16.

In addition, a return pipe 8 also connected to the fuel supply device (not shown) is inserted into the main chamber 3 through the first working hole 5. Further, a first vertical straight portion 11A of a U-shaped suction pipe 11 is also inserted into the main chamber 3 through the first working hole 5, and a second vertical straight portion 11B thereof is inserted into the subchamber 4 through the second working hole 6. These return pipe 8 and the suction pipe 11A are connected to an ejector pump 9 according to the present invention to feed fuel from the subchamber 4 to the main chamber 3 through a filter 12 attached to an inlet port lla of the suction pipe 11.

The ejector pump 9 transfers fuel from the subchamber 4 to the main chamber 3 via the suction pipe 11 by a vacuum generated within the ejector pump 9 when excessive fuel fed by the feed pump 7 to the fuel supply device (not shown) is returned through the return pipe 8 and jetted into the main chamber 3.

The ejector pump 9 of the present invention will be described in detail hereinbelow.

Figure 2A:
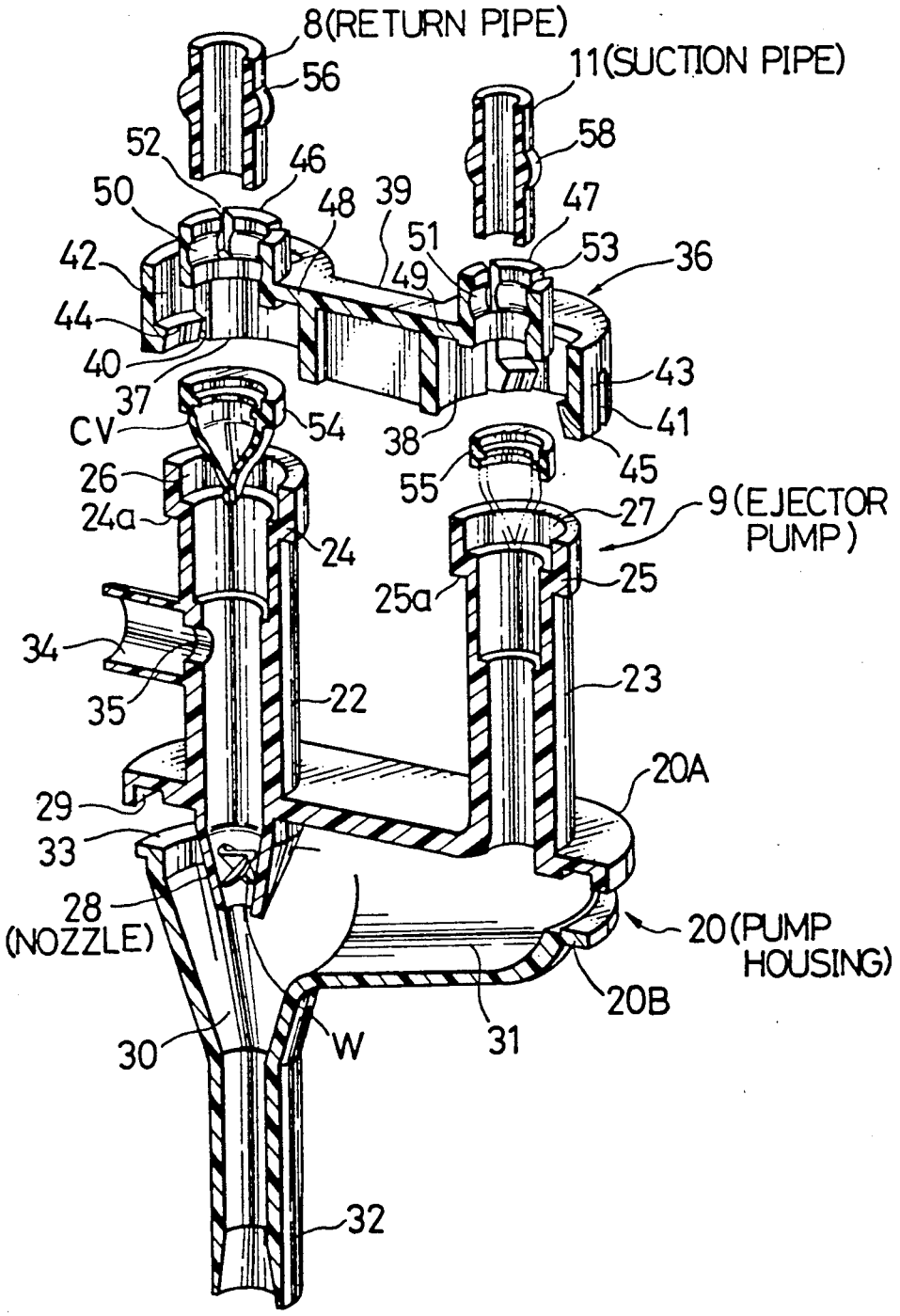
FIG. 2(A) is an exploded view showing a first embodiment of the ejector pump for an automotive vehicle fuel tank according to the present invention.
Figure 2B:
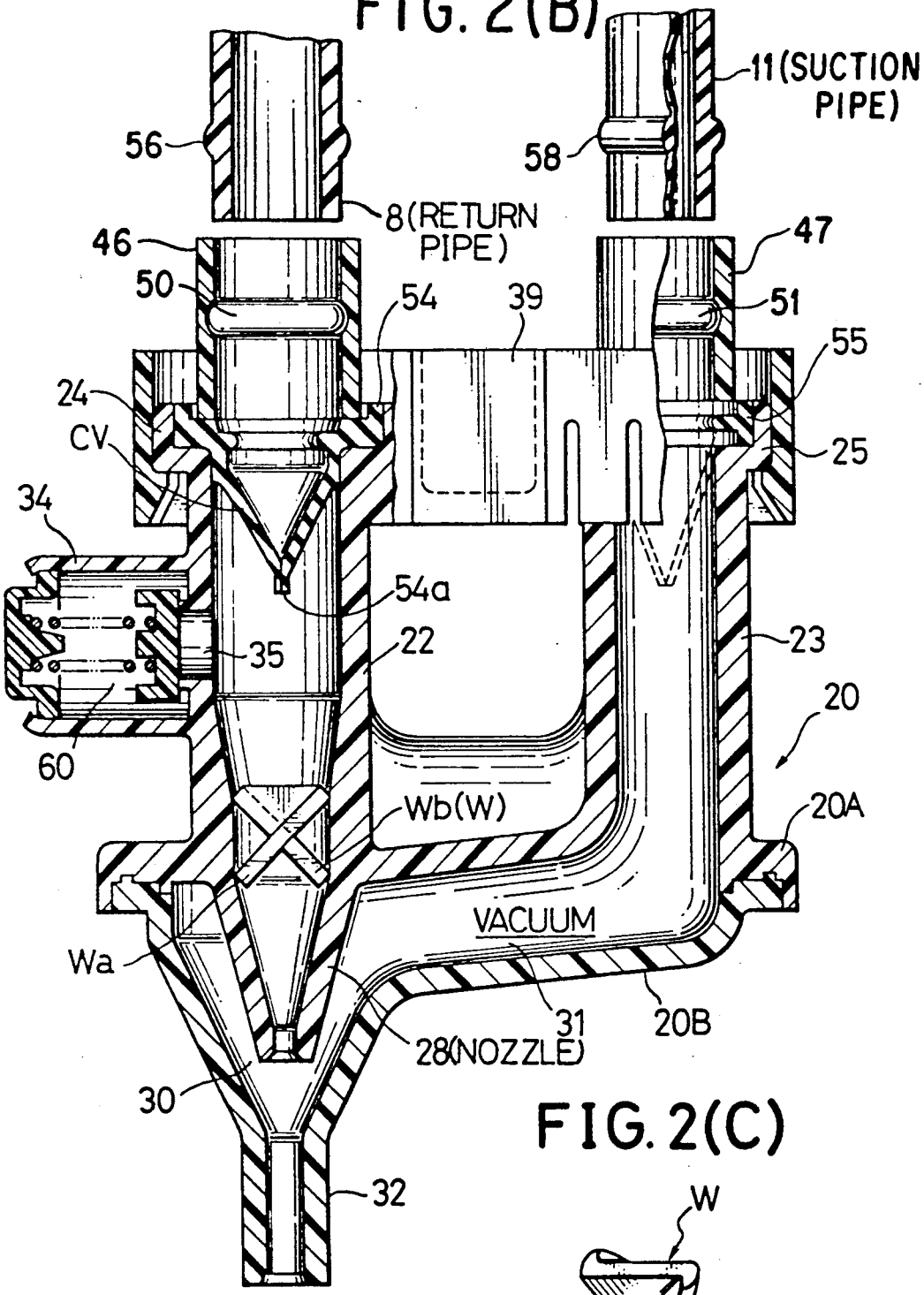
FIG. 2(B) is a cross-sectional view of the ejector pump shown in FIG. 2(A)
Figure 2C:
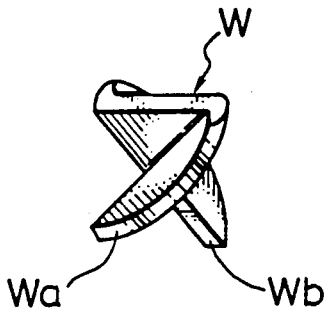
FIG. 2(C) is a perspective view showing a whirler (whirling member) provided in the ejector pump shown in FIG. 2(B)

FIGS. 2(A), 2(B) and 2(C) show a first embodiment of the ejector pump 9, which roughly comprises a pump housing 20 composed of an upper plate 20A and a lower plate 20B both made of a fuel-resistant resin, two seal members 54 and 55 (used in common with two check valves, respectively), and a pipe socket 36. The upper plate 20A is formed integral with a return pipe connecting portion 22 and a suction pipe connecting portion 23 both extending upward in parallel to each other. Further, the return pipe connecting portion 22 is formed with a nozzle 28 at the lower end of the return pipe connecting portion 22. The upper plate 20A is further formed with a lower recessed portion 29 along the peripheral portion thereof.

On the other hand, the lower plate 20B is formed with an upper projection portion 33 along the peripheral portion thereof. Therefore, when the upper and lower plates 20A and 20B are coupled to each other by engaging the upper projection portion 33 of the lower plate 20B with the lower recessed portion 29 of the upper plate 20A, a conical vacuum chamber 30 is formed under and coaxially with the nozzle 28, and additionally a guide chamber 31 is formed extending from the suction pipe connecting portion 23 to the vacuum chamber 30 between the upper and lower plates 20A and 20B. Further, the lower plate 20B is formed with a throat portion 32 under the vacuum chamber 30.

The return pipe connecting portion 22 or the suction pipe connecting portion 23 of the upper plate 20A is each formed with a flange 24 or 25 at each upper end thereof. A seal supporting portion 26 or 27 is formed at each inner circumferential surface of each flange 24 or 25.

Further, the return pipe connecting portion 22 is formed with a communication hole 35 and a branch port 34 at roughly the axially middle portion thereof, and a relief valve 60 (see FIG. 2(B)) is provided within the branch port 34 to relieve pressure which exceeds a predetermined value.

The pipe socket 36 is attached to the flange 24 of the return pipe connecting portion 22 and to the flange 25 of the suction pipe connecting portion 23 of the upper plate 20A via two sealing members 54 and 55 at least one 54 of which simultaneously serves as a check valve CV. The check valve CV is made of an elastic member such as rubber, formed into a reverse conical shape, and formed with a normally-closed lower hole 54*a* at the apex portion thereof. That is, the upper circumferential edge 54 of the check valve CV (54) is used in common with a sealing member. This check valve CV (54) serves to prevent fuel within the ejector pump 9 from flowing in the reverse direction from the main chamber 3 to the outside of the fuel tank 1 for example, when the vehicle is overturned.

Further, it is also preferable to provide another check valve CV (55) on the suction pipe connecting portion 23 by forming a reverse conical portion integral with the and 2(B) in order to prevent fuel from flowing in the reverse direction from the main chamber 3 to the subchamber 4 due to siphonage function of the suction pipe 11, which will be generated after an ignition key has been turned off.

The pipe socket 36 is formed with a return pipe socket portion 37 fitted to the return pipe connecting portion 22 with the sealing member 54 interposed between the two portions 37 and 22, a suction pipe socket portion 38 fitted to the suction pipe connecting portion 23 with the sealing member 55 interposed between the two portions 38 and 23, and a bridge portion 39 for connecting these two portions 37 and 38. Further, the return pipe socket portion 37 is formed with a cylindrical elastic portion 42 having a plurality of axially-extending slits 40 arranged at regular angular intervals and a radially inward extending arcuate claw portion 44. The suction pipe socket portion 38 is formed with a cylindrical elastic portion 43 having a plurality of axially-extending slits 41 arranged at regular angular intervals and a radially inward extending arcuate claw portion 45. Further, a larger-diameter cylindrical pipe adapter portion 46 is formed on the upper opening portion of the induction pipe socket portion 37. This adapter portion 46 is formed with a plurality of slits 52 and an inner annular recessed portion 50 to which an outer annular projection 56 of the return pipe 8 can be smoothly and elastically fitted. In the same way, a smaller-diameter cylindrical pipe adapter portion 47 is formed on the upper opening portion of the suction pipe socket portion 38. This adapter portion 47 is formed with a plurality of slits 53 and an inner annular recessed portion 51 to which an outer projection 58 of the suction pipe 11 can be smoothly and elastically fitted. The above return pipe socket portion 37 and the suction pipe socket portion 38 are connected to each other by two junction walls 48 and 49 of the bridge portion 39.

Further, a whirler W is fixed to the inside of an end of the nozzle 28 in order to effectively whirl and diffuse jetted fuel. As shown in FIG. 2(C), the whirler W is formed with a pair of intersecting blades Wa and Wb. The whirler W serves to effectively promote the ejector function by guiding fuel flowing along the upper surface of one blade Wa or Wb toward the lower surface of the other blade Wb or Wa so that the fuel jetted through the nozzle 28 can be expanded into a conical shape.

The function of the ejector pump 9 thus constructed will be described hereinbelow. When the feed pump 7 is the filter 16 and then fed to the engine fuel supply device (not shown) via the outlet pipe 10. Since all the amount of fuel thus fed is not consumed, excessive fuel is returned from the fuel supply device to the fuel tank 1 via the return pipe 8 under pressure generated by the feed pump 7. That is, fuel returned through the return pipe 8 is fed through the return pipe connecting portion 22 and jetted from the nozzle 28, and further guided downward through the vacuum chamber 30 and the throat portion 32 of the ejector pump 9.

Under these conditions, since a vacuum is generated within the vacuum chamber 30 owing to fuel jetted through the nozzle 28, fuel within the subchamber 4 is sucked from the filter 12 and then fed into the vacuum chamber 30 via the suction pipe 11, the suction pipe connecting portion 3, and the guide chamber 31 of the ejector pump 9, so that fuel within the subchamber 4 is transferred into the main chamber 3 through the threat portion 32 of the ejector pump together with fuel jetted through the nozzle 28. In this fuel jet operation, since fuel jetted through the nozzle 28 is expanded into a conical shape due to the presence of the whirler W, it is possible to effectively isolate the vacuum chamber 30 from the outside, thus promoting ejector function.

The ejector pump 9 of the present invention thus constructed has various advantages as follows:

(1) Since the upper plate 20A and the lower plate 20B can be tightly assembled with each other by engaging the recessed portion 29 of the upper plate 20A with the projection portion 33 of the lower plate 20B and further the pipe socket 36 can be tightly attached to the return pipe connecting portion 22 and the suction pipe connecting portion 23 by engaging the claw portions 44 and 45 of the cylindrical elastic portions 42 and 43 with the annular lower surfaces **24*a* and 25*a* of the flanges 24 and 25 of the pipe connecting portions 22 and 23**, it is possible to facilitate the assembly work and enhance the fitting reliability.

(2) Since the return pipe connecting portion 22 and the suction pipe connecting portion 23 are connected respectively with the return pipe socket portion 37 and the suction pipe socket portion 38 both formed integral with the bridge portion 39, it is possible to improve the strength of these pipe connecting portions 22 and 23 against external forces applied in the radial direction thereof.

(3) Since the diameter of the return pipe 8 is determined larger than that of the suction pipe 11 and therefore the diameters of the return pipe connecting portion 22 and the return pipe socket portion 37 are all determined larger than those of the suction pipe connecting portion 23 and the suction pipe socket portion 38, it is possible to prevent erroneous assembly of these return and suction pipe related elements.

(4) Since the ejector pump 9 is simple in structure and light in weight, it is possible to support the ejector pump 9 by only the pipe socket 36 without providing a special bracket, thus increasing the ejector pump mounting workability and the capacity within the fuel tank, and decreasing the diameter of the working hole 5.

(5) In case the vehicle is overturned due to vehicle collision at accident for instance and therefore the return pipe 8 is damaged, although fuel within the fuel tank 1 tends to flow outside through the ejector pump 9, since the check valve CV used in common with a sealing member 54 is provided within the return pipe connecting portion 22 of the ejector pump 9, it is possible to prevent fuel from flowing in the reverse direction from the fuel tank to the outside via the ejector pump 9 or the return pipe 8.

(6) Since the check valve CV is used in common with the sealing member 54 and further provided inside the ejector pump 9, it is possible to reduce the number of parts and simplify the check valve assembly work, as compared when the check valve is attached to the return pipe 8 outside the fuel tank 1.

Figure 3A:
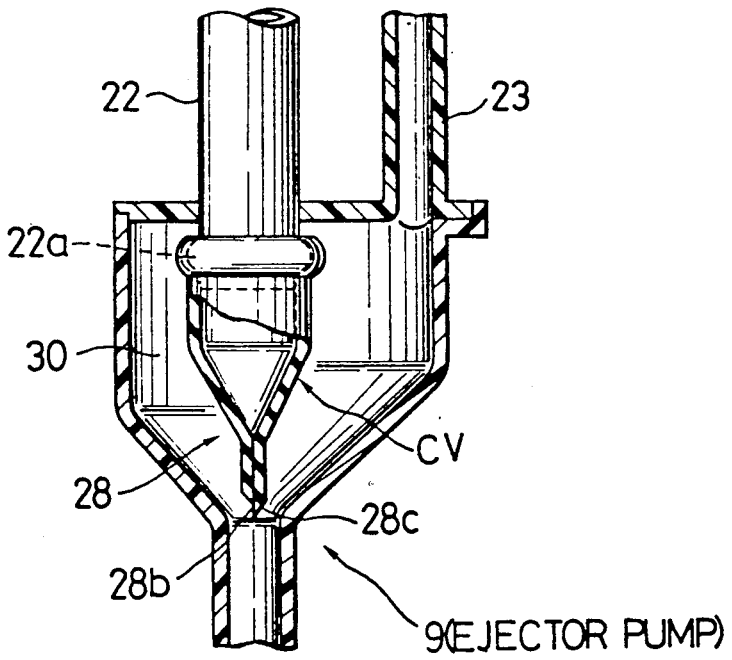
FIG. 3(A) is a cross-sectional view showing an essential portion of a second embodiment of the ejector pump according to the present invention.
Figure 3B:
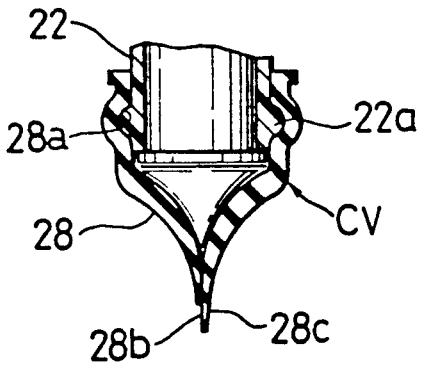
FIG. 3(B) is an enlarged partial cross-sectional view of the ejector pump shown in FIG. 3(A)

FIGS. 3(A) and 3(B) shows a second embodiment of the ejector pump 9 according to the present invention, in which the check valve CV is used in common with the nozzle 28.

In more detail, the return pipe connecting portion 22 projecting into the vacuum chamber 30 is formed with an annular projection portion **22*a* at the lower end thereof, to which an annular recessed portion 28*a* of the elastic nozzle 28 is fitted. The check valve CV is formed into a reverse conical shape and with an elastic lower end hole 28*b***.

Further, as shown in FIG. 3(B), the lower end hole **28*b* is formed into a partially offset state in such a way that the projection length of part of the circumferential edge is shorter than that of the remaining portion of the circumferential edge. Therefore, it is possible to prevent the lower end of the nozzle 28** from being opened due to swelling of the nozzle material (e.g. rubber).

In this embodiment, since the check valve CV is so formed as to construct the nozzle 28, it is possible to simultaneously obtain the ejector function as the nozzle and the reverse-flow prevention function as the check valve required when vehicle is overturned, for instance. In addition, since the nozzle portion 28 is formed into an offset state and therefore the nozzle end is easily deformed, it is possible to prevent abnormal noise from being produced when fuel including vapor or bubbles is returned from the engine to the fuel tank through the nozzle 28 after the ignition key has been turned off.

Figure 4:
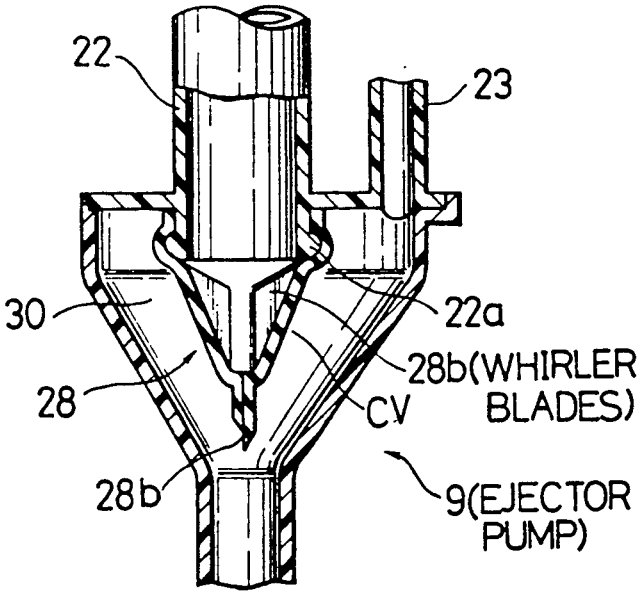
FIG. 4 is a cross-sectional view showing an essential portion of a third embodiment of the ejector pump according to the present invention.

FIG. 4 shows a third embodiment of the ejector pump 9 according to the present invention, in which the check valve CV is used in common with the nozzle 28 and further some whirler blades **28*b* are formed within the inner wall of the nozzle 28 (or the check valve CV) in order to diffuse fuel into a conical shape. In other words, the blades 28*b* are provided so as to obtain the same function as the whirler W shown in FIG. 2(C); that is, to enhance the ejector function. Further, in this third embodiment, the lower end 28***b* of the nozzle 28 is formed partially into an offset state as in the second embodiment.

As described above, in the ejector pump for a saddle-shaped vehicle fuel tank according to the present invention, in case the vehicle is overturned at collision, for instance and therefore the return pipe is damaged, it is possible to prevent fuel from flowing from the fuel tank to the outside through the ejector pump owing to the presence of the check valve. Further, since the check valve is provided within the ejector pump, it is possible to prevent the fuel tank capacity from being reduced by the volume of the check valve. Further, since the check valve is not required to be attached to the return pipe outside the fuel tank, it is possible to facilitate the assembly work. Further, since the check valve is used in common with the sealing member between the return pipe connecting portion 22 and the return pipe 8, it is possible to reduce the number of the parts and the cost thereof. Further, since the check valve is used in common with the nozzle, it is possible to effectively present abnormal noise from being produced when fuel including vapor or bubbles is returned from the engine to the fuel tank through the nozzle 28 after the ignition key has been turned off.

What is claimed is:

1. An ejector pump for use with a saddle-shaped fuel tank for an automotive vehicle to feed fuel from an subchamber to a main chamber via a suction pipe using a vacuum generated by fuel returned from an engine to the fuel tank via a return pipe, comprising:

(a) a return pipe connecting portion for connecting to the return pipe;

(b) a suction pipe connecting portion for connecting to the suction pipe;

(c) a nozzle formed at an end of said return pipe connecting portion, for jetting fuel returned from the engine through the return pipe;

(d) a pump housing coupled to said return pipe connecting portion and said suction pipe connecting portion, said pump housing forming a vacuum chamber under end of said turn and suction pipe connecting portions and forming a thoroat portion under the end of said return pipe connecting portion; and (e) check valve means provided within at least one of said return pipe connecting portion san said suction pipe connecting portion, for normally allowing fuel to flow from the return pipe to the main chamber and preventing fuel from flowing in the reverse direction.

2. The ejector pump of claim 1, wherein said check valve means is formed of an elastic material into a reverse conical shape having a hole at an apex thereof in a partially offset state.

3. The ejector pump of claim 2, wherein said reverse conical shaped check valve is said nozzle formed at the end of said return pipe connecting portion.

4. The ejector pump of claim 1, which further comprises a whirler provides on an upstream side of said nozzle.

5. The ejector pump of claim 3, wherein further comprises whirler blades provided within said reverse conical shaped check valve.

6. The ejector pump of claim 1, wherein a diameter of said return pipe connecting portion is determined larger than that of said suction pipe connecting portion for prevention of erroneous connection of pipes to said two connecting portions.

* * * * *